US008166792B2

(12) United States Patent
Prasser et al.

(10) Patent No.: US 8,166,792 B2
(45) Date of Patent: May 1, 2012

(54) METHOD OF MAKING A SEAMLESS HOT-FINISHED STEEL PIPE, AND DEVICE FOR CARRYING OUT THE METHOD

(75) Inventors: Christoph Prasser, Essen (DE); Rolf Kümmerling, Duisburg (DE); Stefan Wiedenmaier, Aachen (DE); Pierre Lefebvre, Bavay (FR); Rupert Wieser, Seitenstetten (AT); Robert Koppensteiner, Steyr (AT)

(73) Assignee: V & M Deutschland GmbH, Dusseldorf (DE)

( * ) Notice: Subject to any disclaimer, the term of this patent is extended or adjusted under 35 U.S.C. 154(b) by 854 days.

(21) Appl. No.: 11/577,935

(22) PCT Filed: Oct. 25, 2005

(86) PCT No.: PCT/DE2005/001944

§ 371 (c)(1),
(2), (4) Date: Oct. 27, 2008

(87) PCT Pub. No.: WO2006/045301

PCT Pub. Date: May 4, 2006

(65) Prior Publication Data

US 2009/0044883 A1 Feb. 19, 2009

(30) Foreign Application Priority Data

Oct. 25, 2004 (DE) ..... 10 2004 052 406
Oct. 24, 2005 (DE) ..... 10 2005 052 178

(51) Int. Cl.
*B21D 17/02* (2006.01)
*B21B 19/08* (2006.01)

(52) U.S. Cl. ..... 72/370.01; 72/96

(58) Field of Classification Search ..... 72/96, 97, 72/367.1, 368, 80, 95, 208, 209, 370.01, 72/370.04

See application file for complete search history.

(56) References Cited

U.S. PATENT DOCUMENTS 1,497,467 A * 6/1924 Aiken, Jr. ..... 72/97
3,036,696 A * 5/1962 Zimpel ..... 72/348
3,893,321 A * 7/1975 Braunwieser ..... 72/76
4,157,026 A 6/1979 Braunwieser (Continued)

FOREIGN PATENT DOCUMENTS

DE 1 906 961 6/1971

(Continued)

OTHER PUBLICATIONS

Horst Biller: "Das Walzen nahtloser Rohre-Probleme der Verfahrensauswahl", inStahl und Eisen 106, May 5, 1986, p. 431-437.

K.-H. Brensing et al.: ,,III Herstellverfahren, in: Stahlrohrhandbuch, 10. Edition, Vulkan Verlag, Essen, 1986, p. 119-144.

*Primary Examiner* — Teresa Ekiert

(74) *Attorney, Agent, or Firm* — Henry M. Feifreisen; Ursula B. Day

(57) ABSTRACT

In a method of making a seamless hot-finished steel pipe a billet heated to a shaping temperature is pierced by a first shaping to a thick-walled hollow ingot which subsequently undergoes a radial forging process using an internal tool inserted in the hollow ingot and at least two forging jaws of a forging machine. The forging jaws act on the outer surface area of the hollow ingot, wherein the hollow ingot is turned and axially advanced in a clocked manner in the idle stroke phase of the forging jaws.

21 Claims, 3 Drawing Sheets

U.S. PATENT DOCUMENTS

| | | | | | |
|---|---|---|---|---|---|
| 4,190,887 | A | * | 2/1980 | Yoshiwara et al. | 72/209 |
| 4,578,974 | A | * | 4/1986 | Pozsgay et al. | 72/97 |
| 4,899,570 | A | * | 2/1990 | Mills et al. | 72/364 |
| 6,024,808 | A | * | 2/2000 | Kondo et al. | 148/541 |
| 6,799,357 | B2 | * | 10/2004 | Webb et al. | 29/423 |

FOREIGN PATENT DOCUMENTS

| | | |
|---|---|---|
| EP | 0 610 509 | 8/1994 |
| GB | 873 988 | 8/1961 |
| JP | 62 197237 | 8/1987 |
| SU | 1 634 355 | 3/1991 |

* cited by examiner

METHOD OF MAKING A SEAMLESS HOT-FINISHED STEEL PIPE, AND DEVICE FOR CARRYING OUT THE METHOD

BACKGROUND OF THE INVENTION

The invention relates to a method of making a seamless hot-finished steel pipe.

Following the invention by the brothers Mannesmann to produce a thick-walled hollow tubular ingot from a heated billet, many different proposals have been suggested to stretch this hollow tubular ingot in a same hot-working step at same temperature. Keywords include the continuous rolling process, the rotary-forged process, the piercing mill process, and the Pilger step-by-step rolling process (Stahlrohr-Handbuch [Steel Pipe Handbook], 10. ed; Vulkan-Verlag Essen, 1986, III. Manufacturing Processes).

All mentioned processes have their benefits for different size ranges and materials, whereby combinations are possible as well. The continuous rolling process and the piercing mill process are applicable for the size range of 5" to 18", the Pilger-mill process is applicable for the size range of up to 26". When a thicker wall in the range of >30 mm is involved, the continuous rolling process and the piercing mill process are less suitable while the Pilger-mill process, although not encountering any problems with the wall thickness, exhibits a production cycle that is slower. A drawback common to all mentioned processes is the more or less long modification times during a change in size.

The three stages piercing- stretching- reduction-rolling are a characteristic for the production of seamless pipes from a heated billet (H. Biller, Das Walzen nahtloser Rohre—Probleme der Verfahrensauswahl [Rolling of Seamless Tubes—Problems of Process Selection], Stahl und Eisen 106 (1986), No. 9, pages 431-437).

For some time, attempts have been made to save a step in order to lower production and assembly costs. These attempts have shown little success to date.

DE 1 906 961 A1 discloses a method of making seamless tubes from hollow bodies produced by continuous casting. In this known process, the cast strand is divided and the respective section is initially stretched with the assistance of an internal tool and rolling by hot forging. Thereafter, the pre-stretched section is rolled to a tube (shell) by a continuous rolling train, and a finished pipe is made thereform through subsequent stretch-reduction. This proposed process should be applied for mass production of pipes of small diameter from hollow bodies made through continuous casting. The proposal is intended to overcome the problem of excessive strain of the skew rolls during initial stretching.

SUMMARY OF THE INVENTION

It is an object of the invention to provide a production method for seamless hot-finished steel pipes, which has superior yield and productivity than known methods for the size range of 5" to 30" outer diameter and wall thicknesses ≧0.1× outer diameter for the range of 5" to <16" outer diameter or >40 mm wall thickness for the range of 16" to 30" outer diameter, but also for small lot sizes.

Based on the preamble, this object is attained by a method of making a seamless hot-finished steel pipe, in which originating from a billet heated to a shaping temperature, a first shaping produces through a piercing step a thick-walled hollow ingot which is subsequently elongated in a second shaping step at same temperature through rolling accompanied by a change in diameter and wall thickness to form a tube (shell), and from which a finished pipe is produced in a third shaping step through reduction rolling, wherein the second and third shaping steps defined by rolling are replaced by one shaping step in the form of a radial forging process, using an internal tool inserted in the hollow ingot and at least two forging jaws of a forging machine which act on the outer surface area of the hollow ingot, wherein the hollow ingot is turned and axially advanced in a clocked manner in the idle stroke phase of the forging laws.

According to the teaching of the invention, the previously known second and third shaping steps defined by rolling (stretch-rolling and reduction-rolling) are replaced by one shaping step in the form of a radial forging process, using an internal tool pushed into the hollow ingot and at least two forging jaws of a forging machine for acting on the outer surface area of the hollow ingot, whereby a turning and axial advance of the hollow ingot is clocked in the idle stroke phase of the forging jaws. Depending on the type of control, the turning and axial advance of the hollow ingot may be executed simultaneously or time-staggered.

The proposed method has the advantage of allowing an optimal production also of thick-walled tubes while keeping retrofitting times low. Similar to Pilger-milling, the stretching process produces through forging a high elongation also of very thick-walled tubes. As a result, also thick-walled pipes of great pipe length can be produced. A further advantage is the possibility to eliminate the need for the downstream sizing mill, which is otherwise necessary in the majority of applications, because now the thus-produced hot-finished pipe has the finished pipe quality after the stretching process through forging.

The proposed forging process is especially effective and of beneficial quality, when using, instead of two, a total of four forging jaws which act in one plane upon the outer surface area of the hollow ingot in synchronism. It may be advantageous for a better distribution, in particular of the thermal stress, to move the internal tool during forging in a same direction or in opposition to the axial advance.

At great stretch rate (>4) and slight wall thickness (<30 mm), it may be required to apply a separating agent and lubricant, e.g. on phosphate or graphite basis, prior to forging. This prevents the forged hollow ingot from caking together with the internal tool.

The first shaping step may selectively be a hole punching or piercing by means of skew rolls. Following hole punching, the bottom is severed or pierced. Separation may be realized by flame cutting or hot sawing. The hollow ingot produced by hole punching or piercing by means of skew rolls may be forged directly or pre-stretched by a subsequent skew rolling, before receiving the final pipe size through forging.

In this procedure, separation or piercing of the bottom may be omitted after hole punching. A two-high rolling mill or three-high rolling mill is used for skew rolling. Descaling of the outer and/or inner surface is beneficial depending on the preliminary process.

After the normal finishing steps, such as sizing, visual inspection, labeling, etc, the forged finished pipe is either ready for immediate delivery or undergoes, as previously, a heat treatment and/or a non-destructive test. Heat treatment may involve normalizing or tempering. Leveling may be required depending on the demand for straightness. Depending on the delivery demands, it may also be necessary to grind the outer surface or treat it by another suitable material-removing process to eliminate slight unevenness caused by the forging process.

The starting billet being used is either a section of a continuously cast bar, preferably a round cast bar or cast billet (ingot). Depending of the applied piercing process, materials that are difficult to shape, it may be required to pre-shape the cast through rolling or forging. Heating of the initial billet is carried out in a known manner in a rotary hearth furnace or a rocker bar type furnace. When large weights are involved, the use of other heat furnaces, such as, e.g., pit furnaces, is also conceivable.

The device for carrying out the method is characterized by a radial forging machine having a forging stand and at least two forging jaws which are replaceably arranged in the forging stand. The rotary movement as well as the axial advance of the hollow ingot is realized by a manipulator on the entry side as well as on the exit side. To minimize the possible need for leveling, it has proven advantageous to arrange a guide between manipulator and forging stand at least one the exit side. This should ensure that the forged finished pipe leaving the forging stand is substantially held truly axial.

In principle, the forging process is possible with straight forging jaws; however, the surface quality is significantly improved when each forging jaw includes on the side facing the workpiece a narrowing entry portion which terminates in a smoothing part, when viewed in length section. Viewed in cross section, the entry zone is curved concavely, with the radius being always greater in the respective cross section plane than the actual radius of the engaged hollow ingot. The greater curvature in the cross section plane results in a clamping effect. It is however not necessary to provide a separate set of forging jaws for each entry diameter of the hollow ingot; Rather, one set is able to cover a range of different entry diameters.

The inner diameter as well as the inner contour as viewed along the length of the forged finished pipe is essentially determined primarily by the type of internal tool, preferably in the form of a cylindrical mandrel.

The use of a slightly conical mandrel increases the clearance between the forged finished pipe and the internal tool so that the withdrawal of the finished pipe from the internal tool is facilitated. The conicity should, however, be only slight because otherwise the wall thickness, as viewed over the length, would inadmissibly alter.

The use of a stepped mandrel could be useful for the production of axles with thickened ends. Depending on the type of gradation, it may also be possible to make several axles from a hollow ingot. Singling could subsequently be carried out.

A further field of application would be the production of threaded pipes in the form of an integral connection. There would also be the option to directly forge the socket in so-called socket pipes instead separately.

BRIEF DESCRIPTION OF THE DRAWING

The method according to the invention will be described in greater detail with reference to two schematic illustrations.

It is shown in

DETAILED DESCRIPTION OF PREFERRED EMBODIMENTS

Figure 1:
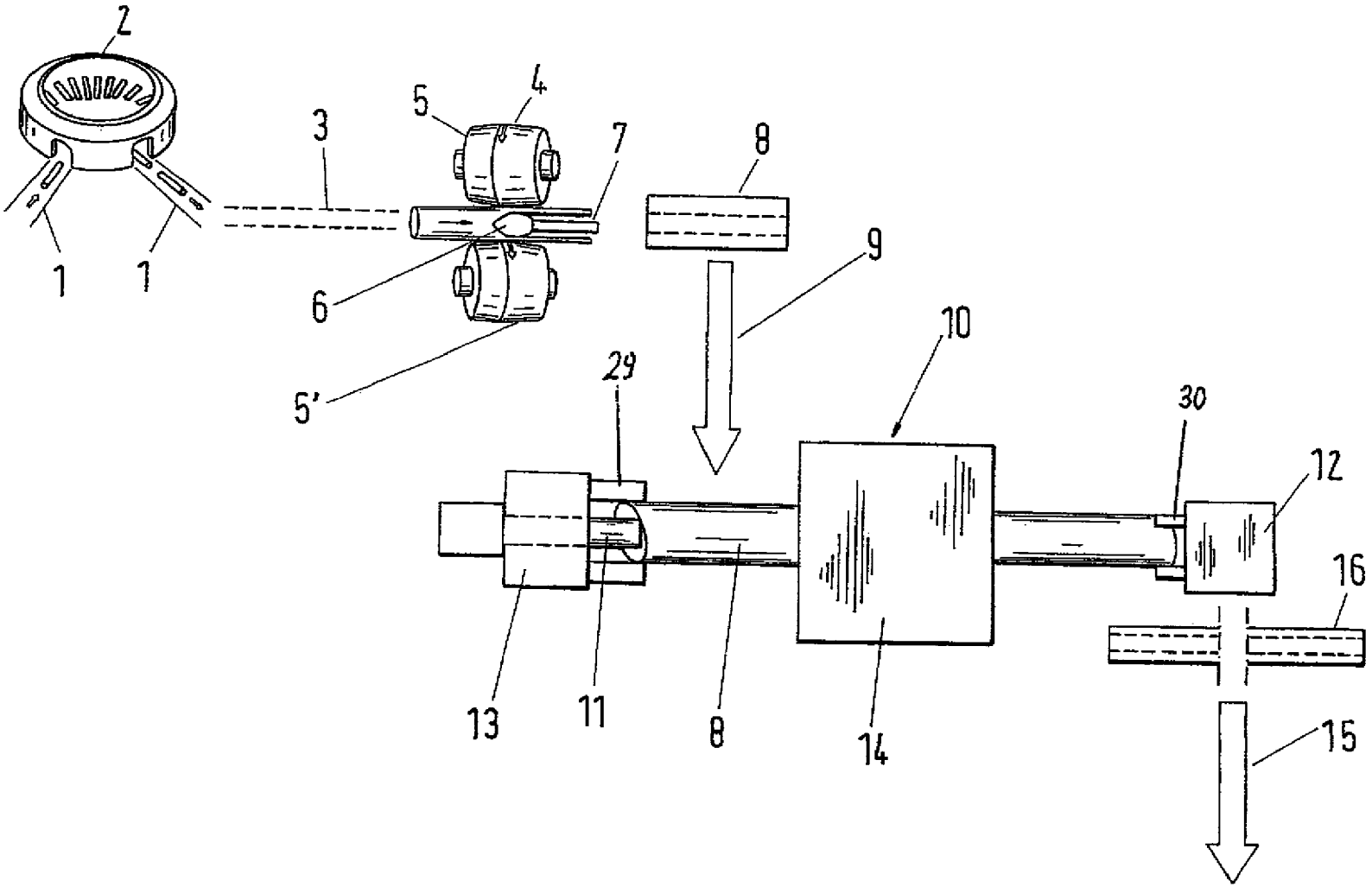
FIG. 1 the method according to the invention with a piercing unit (skew roll), FIG. 2 the method according to the invention with a piercing unit (skew roll) and subsequent pre-stretching unit (elongator), FIG. 3 a longitudinal section of an engaged hollow ingot, FIG. 4 a section in the direction A-A in FIG. 3.

FIG. 1 shows a schematic illustration of the method according to the invention with only one piercing unit as first shaping step. By way of example, a billet 1, sized to length from a cast steel bar is placed in a rotary hearth furnace 2 and heated to a shaping temperature of, e.g., 1250° C. After heating and exiting the rotary hearth furnace 2, the heated billet is fed via a roller table 3 to a piercing unit.

In this exemplified embodiment, the piercing unit is designed as skew rolling mill 4 with two skew rolls 5, 5', and includes an internal tool, comprised of a piercing mandrel 6 and a holding rod 7. As piercing by means of skew rolls is generally known, a more detailed discussion is omitted. Following the piercing step and possible removal of a bottom of the billet 1, the hollow ingot 8 may be descaled on the inside and outside.

Piercing the billet 1 produces a hollow ingot 8 which is fed via a transverse transport 9 to the forging machine 10. The subsequent stretching process by way of radial forging combines in accordance with the invention the otherwise typical second and third shaping steps, in lieu of the otherwise typical rolling process, be it a continuous rolling process, piercing process, or Pilger step-by-step rolling process with subsequent reduction rolls.

After insertion of the internal tool 11, preferably in the form of a cylindrical mandrel, the hollow ingot 8 is transported by a manipulator 13 on the entry side longitudinally through the forging stand 14 and turned at the same time. This rotation and the axial advance of the hollow ingot 8 is clocked in the idle stroke phase of the forging jaws either simultaneously or time-staggered. A guide 29 is provided on the entry side of the forging stand 14 for guiding the hollow ingot 8 during its advance.

On the exit side, a second manipulator 12 receives later the finished pipe 16 in order to allow conclusion of the forging process. The forging unit is shown here only schematically and includes unillustrated forging jaws which embrace the hollow ingot 8 and act upon the outer surface area in order to elongate the hollow ingot 8 through reduction of the outer diameter as well as of the wall thickness As shown in FIG. 1, a guide 30 is arranged between the second manipulator 12 and the forging stand 14.

After the stretching process through forging, the hot-finished pipe 16 is transported to the finishing line according to arrow 15 to make it ready for shipment. Finishing includes typically a sizing to length, visual inspection, labeling, and depending on demand a preceding heat treatment and/or a non-destructive test. For space-saving reasons, the hot-finished pipe 16 is shown shorter as it would be according to the elongation.

By way of example, the operating sequence shown in FIG. 1 produces, after piercing from a billet 1 with a round dimension of 406 mm and a length of 2.8 m, a hollow ingot 8 with a dimension 390 outer diameter×123 mm wall thickness with a length of 3.5 m. After forging, the hot-finished pipe 16 has an outer diameter of 203 mm with a wall thickness of 50 mm and a length of 15 meters.

Figure 2:
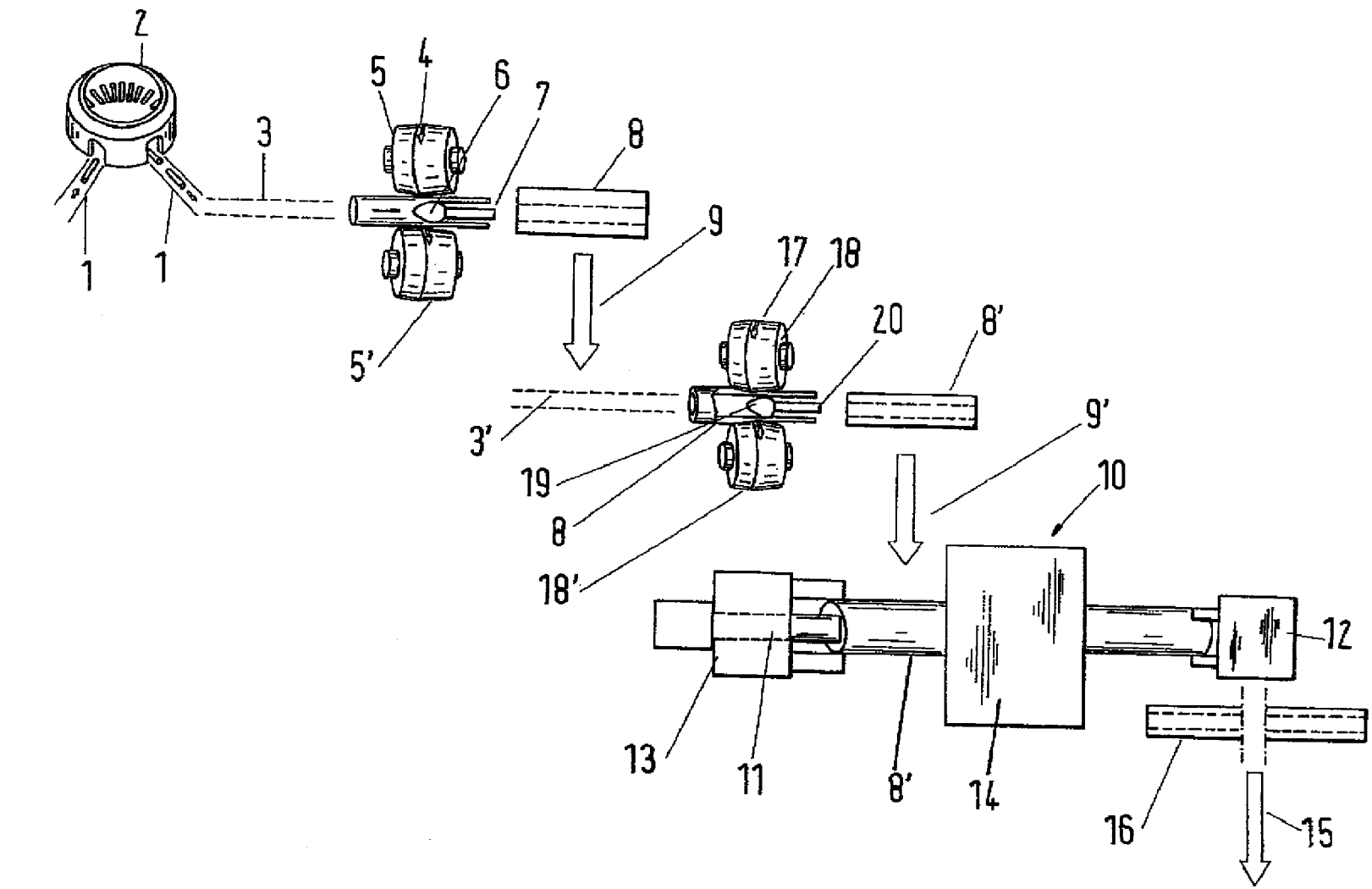

FIG. 2 shows a variation of the method of FIG. 1, whereby same reference numerals have been selected for same parts. The first shaping step up to the production of a hollow ingot 8 is identical with the shaping step described with reference to FIG. 1. Disposed prior to the stretching process through forging, the second shaping step, is a pre-stretching unit, a so-called elongator 17. The elongator is also configured in this exemplified embodiment as a skew rolling mill with two skew rolls 18, 18' and an internal tool comprised of a plug 19 which is connected to a holding rod 20.

The hollow ingot 8 exiting the piercing unit is fed via a transverse transport 9 to the entry side of the elongator 17. Skew rolling per-stretches the hollow ingot 8 and a hollow ingot 8' with reduced wall thickness is produced. The diameter of the hollow ingot 8' may be the same, smaller, or greater after initial stretching.

Subsequently, the hollow ingot 8' can be descaled and is fed via a transverse transport 9' to the forging machine 10, already described with reference to FIG. 1. As the following steps are identical, a repetition thereof is omitted.

By way of example, the operating sequence shown in FIG. 2 produces, after piercing from a billet 1 with a round dimension of 500 mm and a length of 4 m, a hollow ingot 8 with a dimension 500 mm outer diameter×180 mm wall thickness with a length of 4.3 m.

After passing through the elongator, a hollow ingot 8' is produced with the dimensions of 480 mm outer diameter×120 mm wall thickness and a length of 5.8 m.

After the stretching process through forging, the hot-finished pipe 16 has an outer diameter of 339.7 mm with a wall thickness of 75 mm and a length of 12.6 m.

Figure 3:
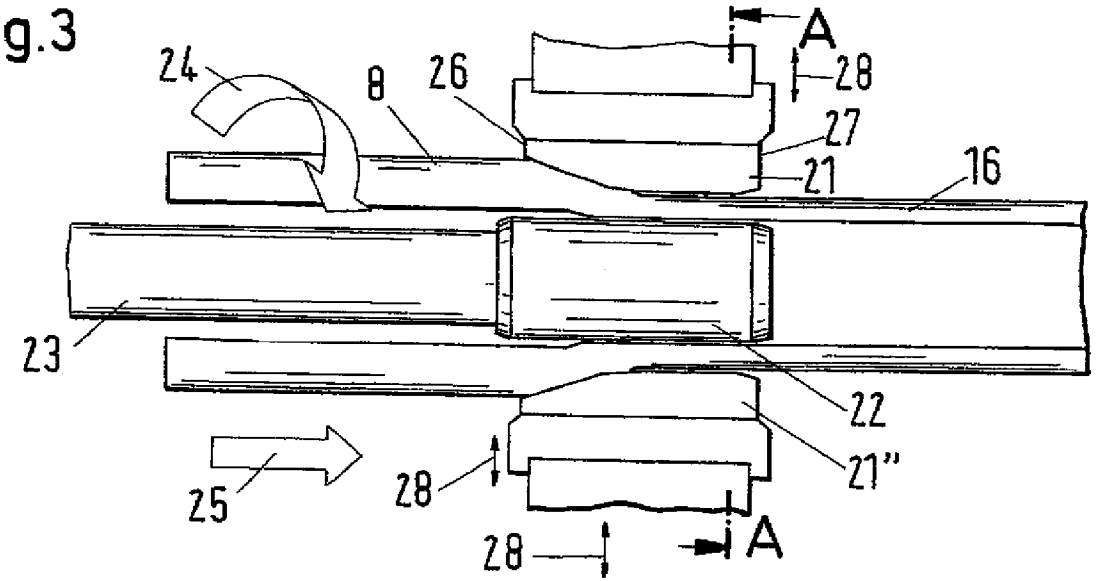

FIG. 3 shows a longitudinal section of an engaged hollow ingot 8 which is to be forged and which enters the forging machine from the left and exits the forging machine on the right in the form of a hot-finished pipe 16. In this exemplified embodiment, four forging jaws 21, 21', 21", 21'" acting on the outer surface in the forging zone cooperate with a cylindrical mandrel 22 on the inside. The mandrel 22 is held in place by a holding rod 23; it may, however, as an alternative, also move axially back and forth during the forging process.

The curved arrow 24 as well as the axial arrow 25 are intended to emphasize that the hollow ingot 8' is rotated and axially advanced during the idle stroke of the forging jaws 21-21'".

In length section, each forging jaw 21-21'" has a predominantly conically designed entry portion 26 which terminates in a smoothing part 27. The entry part 26 may also be curved slightly convex.

As shown in cross section (FIG. 4), all forging jaws 21-21'" have a concave curvature. Normally, the curvature is an arc having a radius which is greater than the actual radius of the part to be forged.

Figure 4:
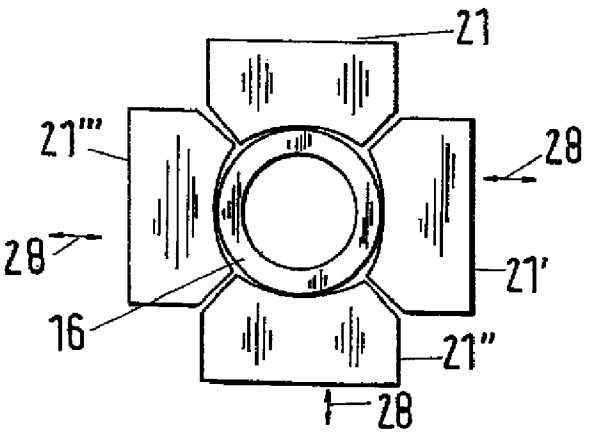

The movement arrows 28, depicted in FIGS. 3 and 4 should indicate the radial stroke of the respective forging jaw 21-21'".

What is claimed is:

1. A method of making a seamless hot-finished steel pipe, comprising the steps of:

piercing a billet, which has been heated to a shaping temperature, in a first shaping step to produce a thick-walled hollow ingot; and subjecting the hollow ingot to a radial forging process in a second shaping step for elongating the hollow ingot at the shaping temperature to change the hollow ingot in diameter and wall thickness and thereby produce a finished pipe, wherein the radial forging process is implemented by an internal tool, inserted in the hollow ingot, and at least two forging jaws of a forging machine which act on an outer surface area of the hollow ingot, wherein the hollow ingot is rotated and axially advanced in a clocked manner in an idle stroke phase of the forging jaws.

2. The method of claim 1, wherein the rotation and axial advance of the hollow ingot are carried out simultaneously.

3. The method of claim 1, wherein the rotation and axial advance of the hollow ingot are carried out time-staggered.

4. The method of claim 1, wherein the radial forging process involves the use of four forging jaws which act in a plane in synchronism upon the outer surface area of the hollow ingot.

5. The method of claim 1, wherein the internal tool is stationary during the radial forging process.

6. The method of claim 1, wherein the internal tool is moved in a same direction as the axial advance during the radial forging process.

7. The method of claim 1, wherein the internal tool is moved in opposite direction to the axial advance during the radial forging process.

8. The method of claim 1, further comprising applying a separating agent and lubricant upon an inner side of the hollow ingot before the start of the radial forging process.

9. The method of claim 1, wherein the first shaping step includes hole punching.

10. The method of claim 9, wherein hole punching includes a piercing of a bottom of the hollow ingot.

11. The method of claim 10, wherein the bottom is severed following hole punching.

12. The method of claim 11, further comprising descaling the hollow ingot inside and outside following hole punching and removal of the bottom.

13. The method of claim 9, further comprising pre-stretching the hollow ingot by means of skew rolls after hole punching.

14. The method of claim 13, further comprising descaling the hollow ingot after the pre-stretching step.

15. The method of claim 1, wherein the billet is pierced by means of skew rolls.

16. The method of claim 15, further comprising pre-stretching the hollow ingot by means of skew rolls after the piercing step.

17. The method of claim 15, further comprising descaling the hollow ingot on the inside.

18. The method of claim 1, further comprising subjecting the finished pipe to a heat treatment.

19. The method of claim 1, further comprising straightening the finished pipe.

20. The method of claim 1, further comprising subjecting an outer surface of the finished pipe to a material-removing process.

21. The method of claim 20, wherein the material-removing process is grinding.

* * * * *